United States Patent [19]

Kurihara et al.

[11] 4,184,780

[45] Jan. 22, 1980

[54] PRINTER

[75] Inventors: Toshio Kurihara, Tokorozawa; Nagao Mizutani, Hachiouji; Yasuo Ohkawara, Sayama, all of Japan

[73] Assignee: Citizen Watch Co., Ltd., Tokyo, Japan

[21] Appl. No.: 745,979

[22] Filed: Nov. 29, 1976

[30] Foreign Application Priority Data

Nov. 29, 1975 [JP] Japan ..... 50-143051

[51] Int. Cl.[2] ..... B41J 3/12; B41J 3/28; B41J 11/20

[52] U.S. Cl. ..... 400/56; 400/58; 400/649; 101/93.03

[58] Field of Search ..... 197/144–149, 197/1 R, 127 R, 129; 101/93.00, 93.02, 287, 269, 93.03, 93.04; 400/648, 649, 56–60, 55

[56] References Cited

U.S. PATENT DOCUMENTS

| | | | |
|---|---|---|---|
| 356,406 | 1/1887 | Hey et al. | 101/234 |
| 2,035,310 | 3/1936 | Florance | 101/407 BP |
| 3,242,859 | 3/1966 | Argerinos et al. | 101/269 |
| 3,361,243 | 1/1968 | Kaiser | 197/2 |
| 3,912,068 | 10/1975 | Kwan et al. | 197/127 R |
| 3,983,803 | 10/1976 | Thomas et al. | 197/149 |
| 4,029,193 | 6/1977 | Kwan | 197/149 |

FOREIGN PATENT DOCUMENTS

| | | | |
|---|---|---|---|
| 2451345 | 6/1976 | Fed. Rep. of Germany | 400/56 |
| 1224696 | 3/1971 | United Kingdom | 101/93.00 |

OTHER PUBLICATIONS

Delapchier et al., Pass Book for Disk Printer, IBM Technical Disclosure Bulletin, vol. 13, No. 8, p. 2350 1/71.

Carpenter et al., Forms Sensor for Automatic Platen, IBM Technical Disclosure Bulletin, vol. 13, No. 12, p. 3643 5/71.

*Primary Examiner*—William Pieprz

*Attorney, Agent, or Firm*—Sherman & Shalloway

[57] ABSTRACT

A printer especially suitable for printing letters and symbols on a recording media having portions of different thickness such as a bank deposit pass book foldable along a folding line. A movable platen is comprised of left and right units and a central unit which are moved toward and away from the recording medium by rotary cams and spring means so that the upper surfaces of the left, right and central units of the platen are always maintained in the same plane parallel with the running path of the printing head. Satisfactory printing can be made irrespective of the difference in the thickness of the portions of the recording medium.

21 Claims, 6 Drawing Figures

PRINTER

BACKGROUND OF THE INVENTION

This invention relates to a printer for use in data processing apparatus, more particularly to a printer capable of readily mounting a deposit pass book of the type foldable in the longitudinal or lateral direction, so as to clearly print the amount of money.

Among the printers utilized in this field there are typing bar type and single element type but each of them is not satisfactory because of its low printing speed. Among improved printers that can print many types of letters and symbols, have high operating speed, and small noise and are of low price may be mentioned wire impact dot matrix type but in these types it is necessary to maintain the gap between a printing head and the surface of a recording medium, that is paper to be about 0.3 to 0.6 mm so that it is difficult to print satisfactory on the surface of a recording medium having different thickness, for example one sheet of a slip or a pile of slips and bank passbooks. For the purpose of eliminating these difficulties and readily mounting and dismounting the recording medium an improved printer has been proposed as described in the specification of Japanese patent application No. 90637 of 1974 in which a platen is retracted at the time of mounting and dismounting the recording medium and at the time of shifting lines and the surface of the medium is urged against a receptor which holds the recording medium at a suitable printing position. According to said patent application one end of a platen supporting lever is secured to the platen and the other end of the lever is pivotally journalled for bringing the platen toward and away from the recording medium. As a consequence, the platen moves along an accurate path so that when the thickness of the medium varies uniform printing cannot be ensured because the surface of the platen is not always in parallel with the surface of the recording medium. To decrease the inclination of the surface of the platen with respect to the recording medium, it is necessary to increase the length of the supporting lever which not only increases the occupation space but also reduces the rigidity. For the purpose of decreasing the amplitude of the oscillatory motion that is the amount of the lateral movement between the pressed state and the separated state of the platen it is desirable to locate as near as possible the center of the swing supporting lever aligned on a plane of the platen upper surface. Such arrangement, however, is difficult to construct because of the presence of a line shifting mechanism. Furthermore, as the supporting lever is pivotally journalled it is necessary to supply lubricating oil to the bearing portion to assure smooth movement and to prevent wear thereof. Since such bearing is located near the path of movement of the recording medium dust tends to deposit on the bearing.

According to said patent application, the platen is driven by a solenoid coil. As described in that application, the solenoid coil has many disadvantages in that it produces mechanical shocks and noise, damages pressure sensitive paper and that it is difficult to control the operating speed. Further in order to maintain the platen in engagement with the receiving member it is necessary to continuously energize the solenoid coil or to provide some mechanism to maintain such engagement. The latter mechanism requires a releasing member for separating the platen, thus complicating the construction and decreasing the reliability.

SUMMARY OF THE INVENTION

Accordingly it is an object of this invention to provide an improved printer that can satisfactorily print letters and symbols on a recording medium having different thickness such as a deposit pass book foldable in the longitudinal or lateral direction or single sheet of slip or a pile of slips, whether the printing is made by contacting the printing head against the surface of the medium or by maintaining them spaced apart a little as in the wire impact dot matrix type, heat sensitive type, electric discharge type, ink jet type and simultaneous printing type.

Another object of this invention is to provide an improved printer provided with a durable recording medium holder having a small friction and wear and easy to maintain.

According to this invention there is provided a printer for printing on a recording medium comprising (a) a printing head movable in parallel with the surface of the recording medium, (b) a movable platen provided on the side of the recording medium opposite the printing head, (c) means for varying the spacing between the printing head and the platen in accordance with the thickness of the recording medium, (d) recording medium positioning means mounted on the frame of the printer in parallel with the path of running of the printing head for maintaining the spacing between the surface of the recording medium and the printing head at a definite value, (e) platen supporting means positioned on the side of the movable platen opposite the recording medium for supporting the movable platen always in parallel with the recording medium positioning means, (f) platen driving means for moving the platen toward and away from the recording medium positioning means through the platen supporting means, and (g) platen control means operatively connected to the platen driving means for stopping the same when the platen reaches a position spaced a predetermined distance from the recording medium supporting means.

BRIEF DESCRIPTION OF THE DRAWINGS

Further objects and advantages of the invention can be more fully understood from the following detailed description taken in conjunction with the accompanying drawings in which.

DESCRIPTION OF THE PREFERRED EMBODIMENT

Figure 1:
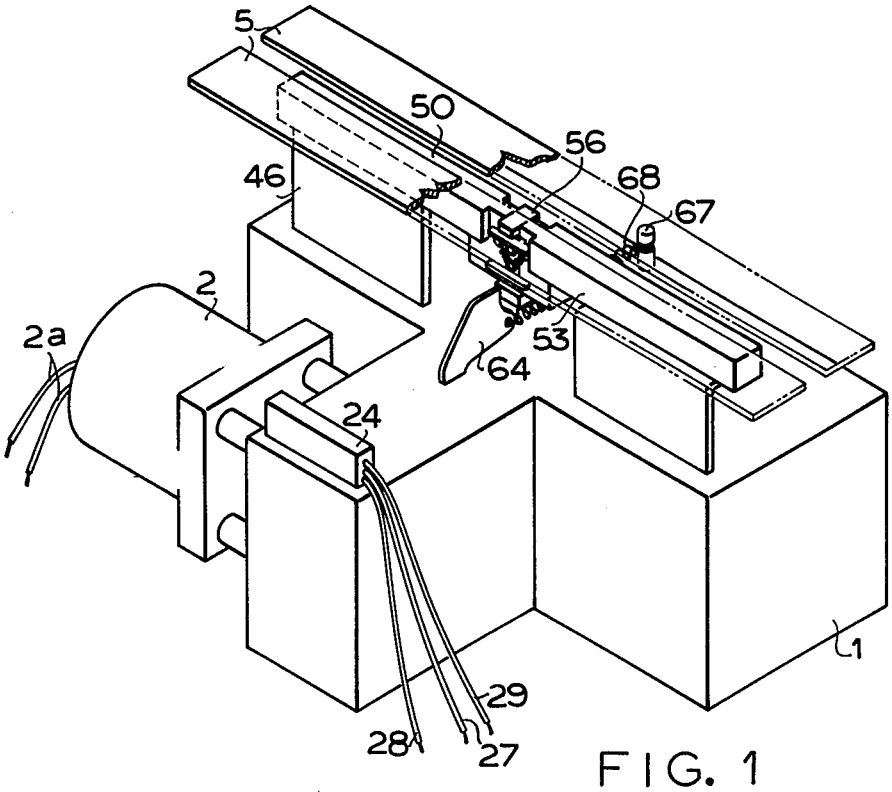
FIG. 1 is a perspective general view showing one embodiment of this invention.
Figure 2:
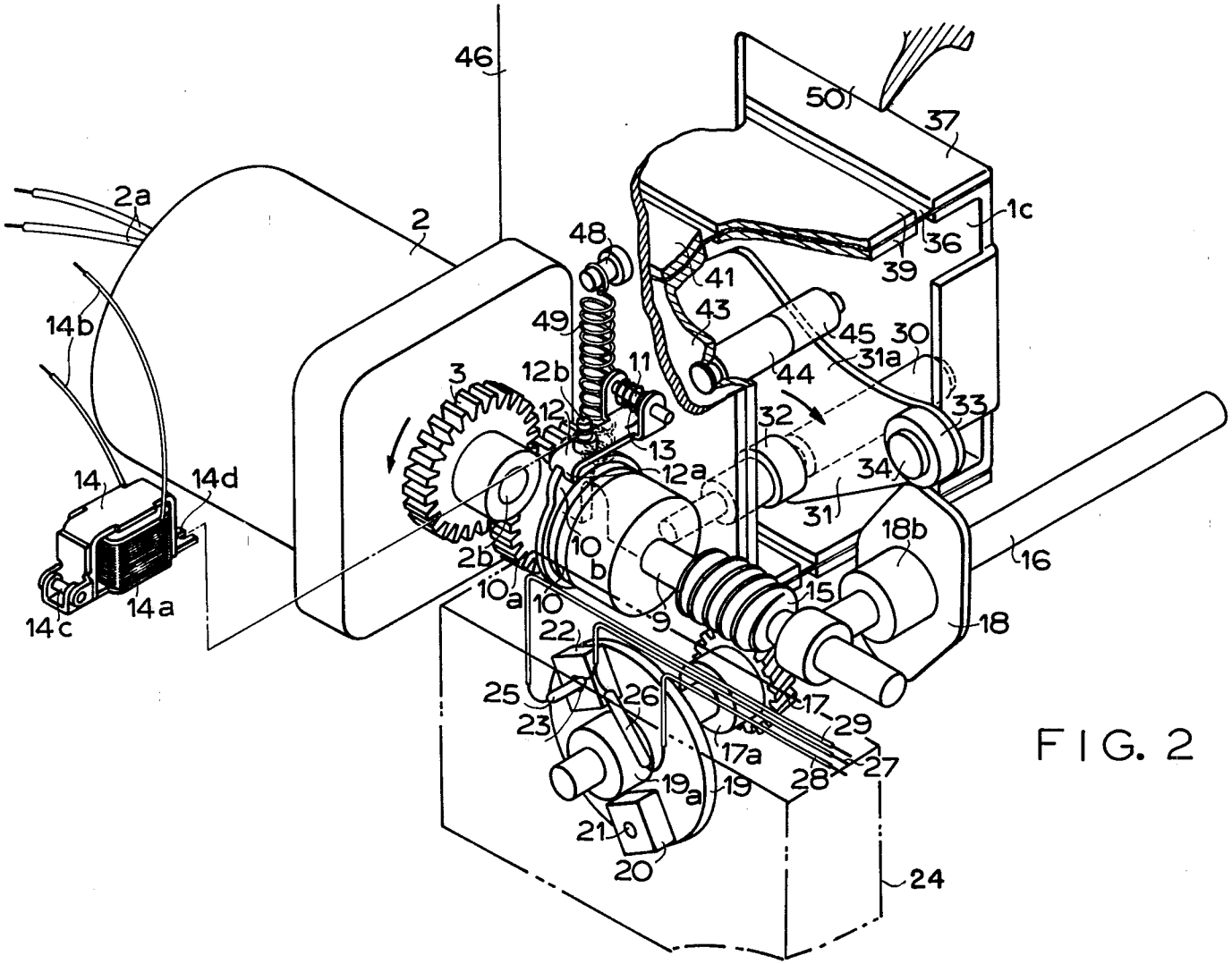
FIG. 2 is a perspective view showing the mechanism contained in the printer shown in FIG. 1.
Figure 3:
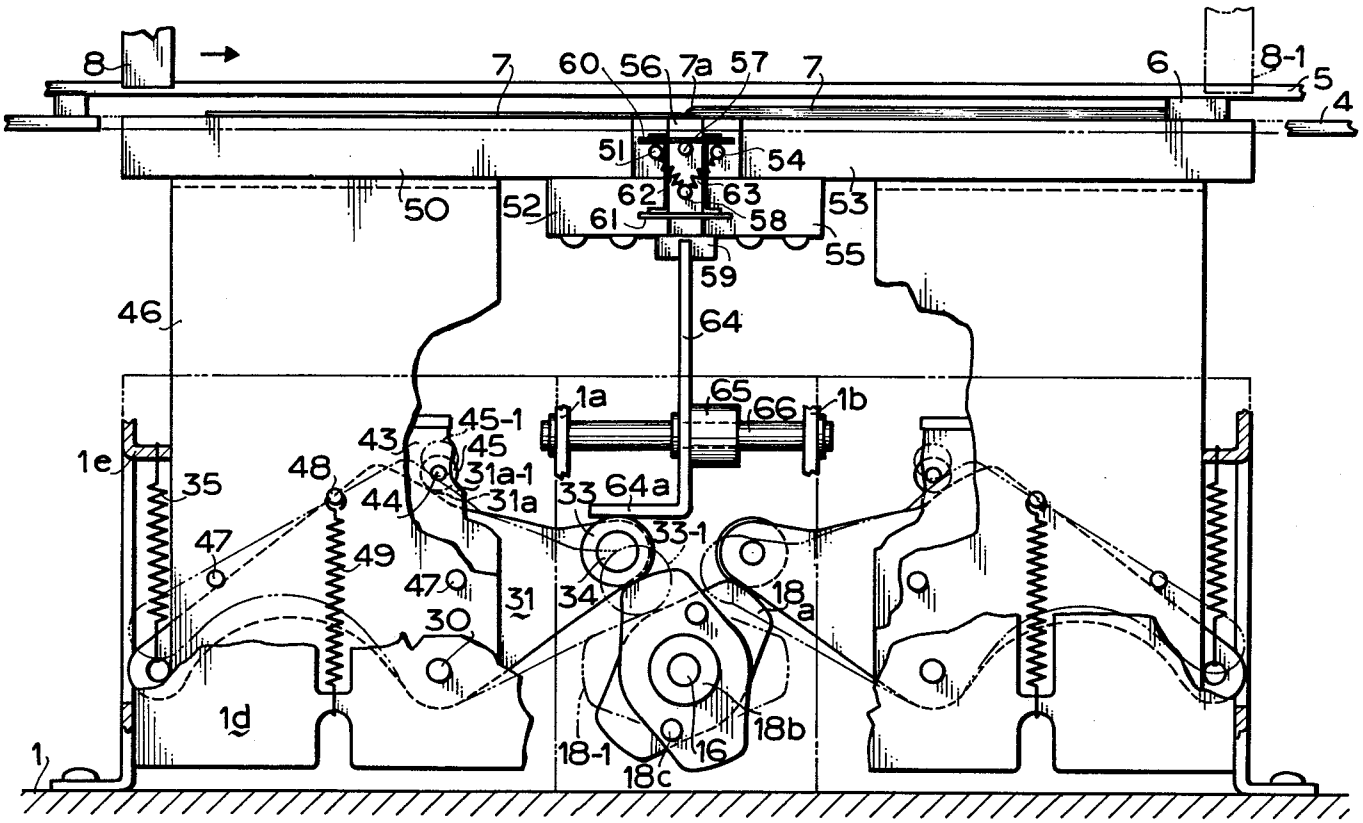
FIG. 3 is a side view of the mechanism shown in FIG. 2.

Referring now to FIGS. 1, 2 and 3, the printer of this invention comprises a frame 1 and a source of drive of the printer, an electric motor 2 for example, which is mounted on a portion 1*a* of the frame 1 and connected to a source of supply, not shown, through lead wires 2*a*. When energized, the motor drives a gear 3 (FIG. 2)

secured to its shaft 2b in the counter clockwise direction as shown by an arrow. A paper table 4 is secured to frame 1 for guiding a recording medium (for brevity hereinafter often called paper) and provided with a slot in which a platen operates as will be described later. Receiving members 5 are also secured to the frame which act as positioning members for holding the printing surface of the paper at a definite distance from a printing head 8. A paper guide 6 (FIG. 3) is secured to the paper table 4 at right angles with respect to the lines of the printed paper and serves to guide the insertion of the paper. In this example the recording media 7 comprises a bank deposit pass book foldable along a center line 7a. A printing head 8 is secured to a carriage, not shown, and may be any one of well-known type, such as wire impact dot matrix type. The carriage is supported by guide rails, not shown, and driven to run in the direction of printing lines by a suitable driving means, not shown. Hereinafter there will be described platen driving means in detail. A motion transmission shaft 9 is rotatably supported by frame 1 and connected with a spring clutch 10 having a gear 10a meshing with gear 3 driven by the motor 2. A control disc 10b provided with pawl is rotatably mounted on the motion transmission shaft 9 adjacent gear 10a. Although not shown in the drawing, a spring is provided between a pin projecting from the gear 10a and pin secured to the motion transmission shaft 9. One end of the spring near the gear 10a is connected to the control disc 10b while the other end near the shaft 9 is secured to the pin secured to the shaft 9. Accordingly, when the rotation of the control disc 10b is arrested by the trigger lever 12 while gear 10a is rotated by the output shaft 2b of the motor, the rotation of gear 10a will not be transmitted to shaft 9, whereas when the control disc 10b is released the rotation of the gear 10a will be transmitted to shaft 9 through the spring, whereby the shaft 9 is rotated in unison with gear 10a. As shown in FIG. 2, a clutch trigger shaft 11 is secured to the frame 1.

Hereinafter, platen control means will be further described. A trigger lever 12 rotatably mounted on the clutch trigger shaft 11 is provided at its free end with a bent portion 12a adapted to engage the control disc 10b of the spring clutch 10. At the center of the trigger lever 12 is secured an operating pin 12b for operating the trigger lever 12 from outside of the apparatus. One end of a trigger lever reset spring 13 is connected to the frame 1 and the other end to the trigger lever 12 for urging the bent portion 12a of the trigger lever 12 to engage the control disc 10b. A trigger solenoid 14 is secured to the frame 1 so that when its coil 14a is energized through lead wires 14b, an armature 14d of the trigger solenoid 14 is attracted to rotate about a pin 14c. The slot formed on the free end of the armature 14d is adapted to freely receive the operating pin 12b of the trigger lever 12 so that the armature 14d is biased by the trigger lever reset spring 13 in a direction opposite to the direction of attraction thereby engaging a stopper, not shown. A worm 15 is mounted on the motion transmission shaft 9. The worm 15 is engaged with a worm wheel 17 mounted on a cam shaft 16. The cam shaft 16 is rotatably supported by the frame 1. A pair of cams 18 and 18a having the same shape but angularly positioned to be out of phase with each other by 60° and are connected together by a bushing 18b and coupling pins 18c. The bushing 18b is secured to cam shaft 16 to rotate therewith. A disc 19 is secured to the cam shaft 16 for supporting detecting members set forth below. Permanent magnets 20 and 21 are secured to the disc 19 by pins 21 and 23 respectively at a peripheral spacing of 180°. A holder 24 for a platen position detector (to be described later) is secured to the frame. The holder 24 also supports a pair of reed switches 25 as a second detector and 26 as a first detector, one terminals thereof being connected to a control circuit, not shown, through a lead wire 27 while the other terminals of the reed switches 25 and 26 being connected to the control circuit via lead wires 28 and 29 respectively.

Figure 4:
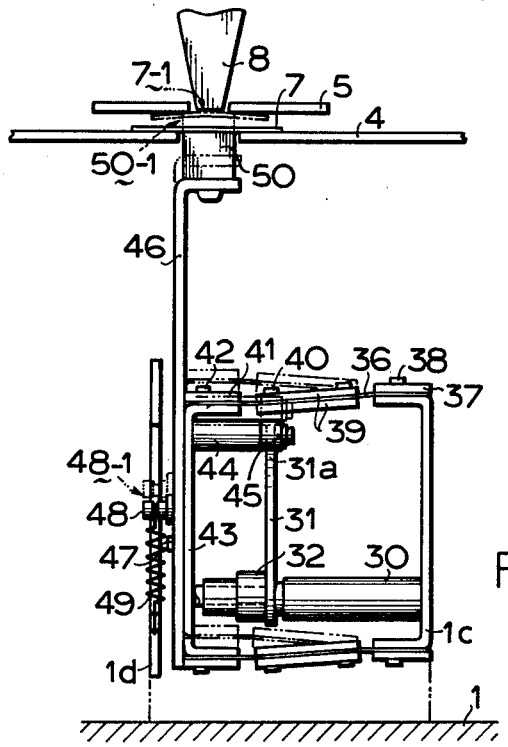
FIG. 4 is a sectional view of the mechanism shown in FIG. 3.

Hereinafter, the motion converting means will be described in detail. A platen push up plate shaft 30 is mounted on a portion 1c of the frame 1, and a platen push up plate 31 is secured to a bushing 32 which is rotatably mounted on the platen push up plate shaft 30. On one end of the platen push up plate 31 is rotatably mounted a follower roller 33 through a pin 34, whereas a cam surface 31a for pushing up a lifting roller 45 (to be described later) is formed on the other portion of the platen push up plate 31. One end of a spring 35 for resetting the platen push up plate 31 is connected to the other end thereof, whereas the other end of the spring 35 is connected to a lug 1e of the frame 1, as best shown in FIG. 3 so as to bias the platen push up plate 31 in the clockwise direction thus urging the follower roller 33 against rotary cam 18. Hereinafter, platen supporting means will be described in detail. A leaf spring 36 is clamped between clamping plates 37 and the one end of the spring 36 is connected to one end of a portion 1c of the frame by connecting pins 38 as best shown in FIG. 4. The other end of the leaf spring 36 is clamped between clamping plates 41 and secured to the upper end of a lifting plate 43 by means of a connecting pin 42. The intermediate portion of the leaf spring is clamped between clamping plates 39 by means of a pin 40. The upper leaf spring 36 is provided with one end firmly clamped by means of the portion 1c of the frame 1 and the clamping plates 37, with the opposite end firmly clamped by means of the upper end of the lifting plate 43 and clamping plate 41, and with the central portion firmly clamped by means of the two clamping plates 39. In such structure, the leaf spring 36 can be bent only at two portions not clamped with the clamping plates 41, 39 and 37 and the lifting plate 43 and the portion 1c. In addition, the lower leaf spring is also clamped with clamping plates. As the result, the lifting plate 43 is supported on the leaf springs 36 so that the platen supporting means can support said movable platen in parallel with the positioning means. An identical leaf spring is also provided between the lower ends of the portion 1c and the lifting plate 43. The lifting plate 43 is provided with a pin 44 for rotatably supporting a lifting roller 45. As shown in FIG. 4, a platen supporting plate 46 is connected to the lifting plate 43 by means of a pin 47. One end of a platen reset spring 49 is connected to a pin 48 secured to the platen supporting plate 46 while the other end to a portion 1d of the frame 1 for biasing the assembly of the platen supporting plate 46 and the lifting plate 43 thus urging the lifting roller 44 against the cam surface 31a of the platen push up plate 31.

The platen comprises a left hand platen unit 50 and a right hand platen unit 53. The left hand platen unit 50 is mounted on the platen supporting plate 46. In the position shown in FIG. 4, the upper surface, that is the paper engaging surface of the Unit 50 is maintained in the same plane as the upper surface of the paper table 4. A pin 51 to which a spring (to be described later) is secured, is to one side of the left hand unit 50 and an auxiliary member 52 is secured to the underside thereof. In the same manner, a pin 54 to which a spring (to be described later) is secured to one side of the right hand platen unit 53 and an auxiliary member 55 is secured to the underside thereof. The left and right hand platen units 50 and 53 are driven by the rotary cam 18*a*. Initially the upper surface, that is the paper engaging surface of the left hand platen unit 50 is maintained in the same plane as the upper surface of the right hand platen unit 53. Between the left and right hand platen units 50 and 53 is positioned a central platen unit 56 which is loosely received in the rectangular openings of guide plates 60 and 61 with small gaps therebetween. The central platen unit 56 is provided with a pin 57 for supporting the guide plate 60 and a pin 58 for securing a spring (to be described later) on one side and a shoulder member 59 on the lower surface. The opposite ends of the guide plates 60 and 61 are formed with rectangular nôtches for loosely receiving one ends of the left and right platen units 50 and 53, respectively with small gaps therebetween. Thus the guide plates 60 and 61 cooperate with the left and right hand platen units 50 and 53 and with their auxiliary members 52 and 55 for vertically guiding the central platen unit 56 while preventing it from inclining in any direction. A spring 62 is connected between pin 51 of the left hand platen unit 50 and the pin 58 of the central platen unit 56 while a spring 63 is connected between pin 54 of the right hand platen unit 53 and the pin 58 of the central platen unit. Although not shown in the drawing, similar springs are provided on the rear side of the platen units. Thus, a total of four springs cooperate to urge upwardly the central platen unit 56 thereby urging the shoulder member 59 to engage against the platen auxiliary members 52 and 55. Under these conditions, the upper surface, that is the paper engaging surface of the central platen unit 56 is maintained to be flush with the upper surfaces of the left and right hand platen units 50 and 53. Accordingly, the central platen unit 56 will be flush so long as the upper surfaces of the left and right hand platen units 50 and 53 are maintained in the same plane. However when either one of the left and right hand platen units 50 and 53 is lowered, the central platen unit is caused to lower together with the lowered unit thus strongly depressing downwardly the paper engaging surface of the central unit 56 against the force of four springs.

Figure 6:
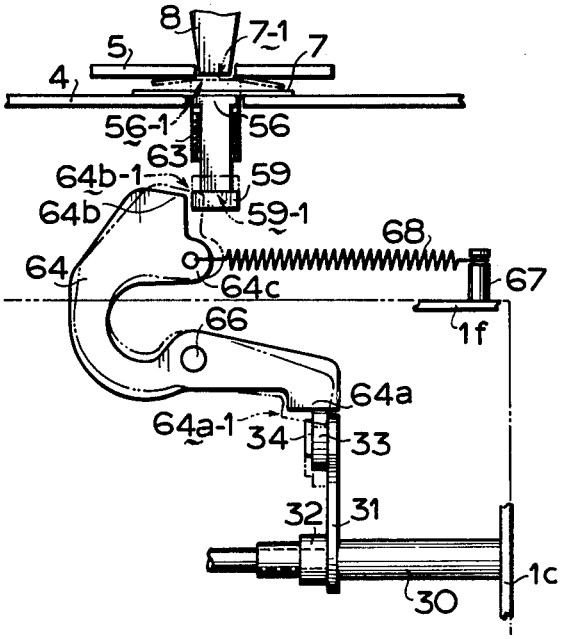
FIG. 6 is a side view showing a platen locking lever.

As shown in FIGS. 3 and 6, a locking lever 64 for locking the central platen unit 56 is fitted on a bushing 65 which is rotatably supported by a shaft 66 secured to the portion 1*a* of the frame 1. The locking lever 64 is provided on one end with a lateral projection 64*a* cooperating with the follower roller 33 and a locking portion 64*b* on the other end. A spring 68 is connected between an opening 64*c* of to the locking member 64 and a pin 67 secured to a portion 1*f* of the frame 1 for biasing the locking lever 64 in the clockwise direction as viewed in FIG. 6 thereby urging the lateral projection 64*a* against the follower roller 33. When the platen push up plate 31 is maintained in the position shown in FIG. 3, that is when the upper surface of the platen units 50, 53 and 56 are maintained to be flush with the upper surface of the paper table 4 the locking lever 64 is maintained in the position shown in FIG. 6 in which the locking portion 64*b* is slightly spaced from the positioning member 59 secured to the lower side of the central platen unit 56.

The printer described above operates as follows. Where printing is made on a recording media having different thickness in the direction of printing such as a foldable deposit pass book, the recording media is mounted on the paper support 4 as shown in FIG. 3 and then pushed to the right along paper guide 6 by means of a paper feeder, not shown, to a desired position at which a line to be printed comes immediately beneath the path of the printing head 8. The platen is initially located such that its central platen unit 56 comes to face the folding line 7*a* of the recording medium, the thickness of the medium differing on both sides of the folding line. After positioning the recording medium 7 in this manner, the control circuit, not shown, energizes the motor 2, FIG. 2, to start it. As a consequence, the gear 10*a* of the spring clutch 10 is rotated in the clockwise direction by gear 3. Under these conditions, however, as the spring clutch 10 is maintained disengaged, the motion transmission shaft 9 will not be rotated.

Then the control circuit energizes the coil 14*a* of the trigger solenoid 14 through the lead wire 14*b* to rotate and attract the armature 14*d* about the pin 14*c* so as to rotate the trigger lever 12 about the pin 11 through the operating pin 12*b* secured to the trigger lever 12 against the trigger lever reset spring 13. Consequently, the bent portion 12*a* of the trigger lever 12 releases the control disc 10*b* of the spring clutch 10 thus causing it to engage. In this manner, it is possible to transmit driving power to the motion transmission shaft 9 for starting the platen at any desired time with a small control power without accompanying any noise and shock. When the spring clutch 10 engages, the rotation of the gear 10*a* rotates the shaft 9 through the spring clutch 10 thus rotating the worm 15 in the clockwise direction. Then the worm wheel 17 and the cam shaft 16 secured thereto rotate in the counter clockwise direction, together with the rotary cams 18 and 18*a*.

As the rotary cam 18 rotates, the cam follower roller 33 is moved from the high portion to the low portion of the rotary cam 18 so as to rotate the platen push up plate 31 in the clockwise direction by the reset spring 35 as viewed in FIG. 3. As the platen push up plate 31 moves, the cam portion 31*a* of the platen push up plate 31 pushes the lifting plate 43 and the platen supporting plate 46 secured to the lifting plate 43 through the lifting roller 45 against in force of a reset spring 49 in a direction of the platen positioning means 5. As the rotary cam 18 continues its rotation to the dotted line position 18-1, the follower roller 33 will come to the dotted line position 33-1 thus bringing the cam portion 31*a* to the dotted line position 31*a*-1 and the lifting roller 45 to the dotted line position 45-1. Describing the operation described above with reference to FIG. 4, the lifting plate 43 and the platen supporting plate 46 raised by the lifting roller 45 are supported by upper and lower parallel leaf springs 36 having one ends secured to the portion 1*c* and the intermediate portion clamped between the clamping plates 39. The opposite ends of the leaf springs 36 clamped by the clamping plates 39 are bent slightly. This supporting structure prevents the platen from inclining in any direction and from shifting in the longitudinal and lateral directions. Further, as there is no sliding portion, there is no wear and the need for the oiling of parts is not necessary.

The left hand platen unit 50 secured to the supporting plate 46 is raised together with the recording medium 7 mounted thereon by the upward motion of the cam portion 31*a* of the platen push up plate 31, and then stopped when the left upper surface of the recording medium 7 comes to engage the receiving members 5. In the same manner, the right hand platen unit 53 is raised by the rotary cam 18*a* until the right upper surface of the recording medium 7 engages the receiving members 5, and this pushing condition is called the "urging position". However, as shown in FIG. 3, the thickness of the recording medium 7 is larger on the right hand side than on left hand side, the left hand platen unit 50 rises close to the receiving members 5 but the right hand platen unit 53 stops at a lower position remote from the receiving members 5. At this time, the upper surface of the central platen unit 56 cannot rise higher than the upper surface of the right hand platen unit 53 because the upper surface of both units are secured to the positioning member 56 via the thicker portion of the pass book. This is because the the thicker portion of the deposit pass book of a bank or a post office slightly projects downwardly, the upper surface of the central platen unit 56 being depressed downwardly. Accordingly, the upper or printing surface of the recording medium 7 whose thickness is different on both sides of the folding line becomes flush thereby enabling printing by straight forwardly running printing member 8. When the platen is brought to this state, the magnet 20 secured to the disc 19 rotating with the rotary cam 18 comes to approach the reed switch 26. Thus, this reed switch 26 is closed to interconnect the lead wires 27 and 28. Accordingly, the printable condition of the platen is detected and a signal representing this condition is transmitted to the control circuit. In response to this signal, the control circuit deenergizes the trigger solenoid 14, with the result that the armature 14*d* and the trigger lever 12 are returned to the original positions by the trigger reset spring 13 thus causing the bent portion 12*a* of the trigger lever 12 to arrest the control disc 10*b* of the spring clutch 10. Accordingly, the spring clutch 10 is disengaged stopping the transmission of the rotational force from the motor 2 to the motion transmission shaft 9 and the cam shaft 16. However, due to the inertia of the cams 18 and 18*a* and the disc 19 the cam shaft 16, the worm wheel 17 tends to urge the worm 15 in the axial direction, such axial thrust being received by the frame 1 through a bearing member, not shown. The worm 15 cannot rotate as a consequence of the axial thrust so that the spring clutch 10 will not be damaged by undue force. This results as the rotary cam 18 stops immediately, and is caused overrun by the inertia so that the follower roller 33 will not disengage the high portion of the rotary cam 18. In this manner, the platen is stopped accurately at the predetermined depressed position or separated position. At the same time, the control circuit stops the motor 2. Thus, the printer can be stopped calmly at any desired time without any noise and shock. Moreover, as the raised condition or the printable condition of the platen can be perceived at a glance, its operation with reference to other mechanisms can be performed correctly.

The operation of the locking lever 64 for the central platen unit which occurs when the platen is raised will now be described with reference to FIG. 6. As has been pointed out in the foregoing description, the follower roller 33 moves from the high portion to the low portion of the rotary cam 18 as it rotates. Then the locking lever 64 is rotated in the clockwise direction by the spring 68 until a locking portion 64*b* engages the shoulder member 59. Then the locking lever 64 is stopped at that position even when the follower roller 33 descends further. The central platen unit 56 continues to rise until the thicker portion of the recording medium comes to engage the receiving members 5. At this time, since the shoulder member 59 makes contact with the platen auxiliary member 55 connected to the right hand platen unit 53, the shoulder member 59 does not rise to such position where the portion 64*b* of the locking member 64 disengages the shoulder member 59 and comes below it. Thus, under these conditions, since the central platen unit 56 is not locked by the locking lever 64, it is possible to depress the central platen unit 56 against the force of the springs 62 and 63. Since in this example, the object to be printed is a deposit pass book no printing is made at the central portion including the folding line.

Where the recording medium is thinner than the deposit pass book, for example, a single sheet of a slip or piled up slips or a laterally foldable deposit pass book as shown in FIG. 6, the central platen unit 56 is brought closer to the receptor members 5 so that the shoulder member 59 rises to a position higher than the position when printing on the deposit pass book so that the portion 64*b* of the locking lever 64 slips into the space beneath the shoulder member 59. As the shoulder member 59 rises the portion 64*b* moves to the right, and when the central platen unit 56 stops, as shown by dotted line 56-1, the shoulder member 59 and the locking portion 64*b* come to positions shown by 59-1 and 64*b*-1 respectively. As a consequence, since the central platen unit 56 is locked with the upper surface of the recording medium 7 urged against the receiving members 5, the entire upper surface of the recording medium 7 becomes flush at portions urged by the left hand, right hand and central platen units 50, 53 and 56, which is the position suitable for the uniform printing by the printing head 8 of any type. In other words, so long as the thickness of the recording medium is such that it permits the locking portion 64*b* of the locking lever 64 to engage the shoulder member 59, uniform printing can be made on any portion of the printing medium.

Since the reed switch 26 detects the printable condition of the platen, the control circuit moves the printing head 8 along the platen so as to print a line.

Upon completion of the printing operation, the control circuit energizes motor 2 to cause its output shaft 2*b* to rotate in the counter-clockwise direction. Accordingly, the gear 10*a* of the spring clutch 10 is rotated in the clockwise direction. However, at this time, since the spring clutch 10 is disengaged the motion transmission shaft 23 will not be rotated. Thereafter, the control circuit energizes the trigger solenoid 14 to attract armature 14*d* for rotating the trigger lever 12 about the pin 11 through the operating pin 12 and against the force of the reset spring 13. Accordingly, the bent portion 12*a* of the trigger lever 12 releases the control disc 10*b* thereby engaging the spring clutch 10. Then the gear 10*a* rotates the motion transmission shaft 9 through the clutch so that the worm 15 rotates the worm wheel 17 and the cam shaft 16 in the counter-clockwise direction.

Consequently, the rotary cams 18 and 18*a* and the disc 19 which are secured to the cam shaft 16 also rotate. As the rotary cam 18 rotates the follower roller 33 moves from the low portion to the high portion of the rotary cam 18 thus rotating the platen push up plate 31 in a direction opposite to the arrow. Thus, when the platen push up plate 31 is rotated in the counter-clockwise direction against reset spring 35, the lifting plate and the platen supporting plate 46 are moved downwardly by the platen reset spring 49 through the lifting roller 45 to follow up the cam portion 31*a*. As the rotary cam 18 continues to rotate to the back original position shown in FIG. 3 by solid line, the platen push up plate 31, the platen supporting plate 46 and the left hand platen unit 50 also come to the positions shown in FIG. 3.

In the same manner, the right hand platen unit 53 is also operated simultaneously by the rotary cam 18*a*. The central platen unit 56 also descends to the position shown in FIG. 3 while maintaining its relative position with respect to the left and right hand platen units 50 and 53 shown in FIG. 3. The above description relates to the operation of the printer where the thickness of the recording medium is large as in the case of a deposit pass book and where the locking lever does not lock the central platen unit.

Figure 5:
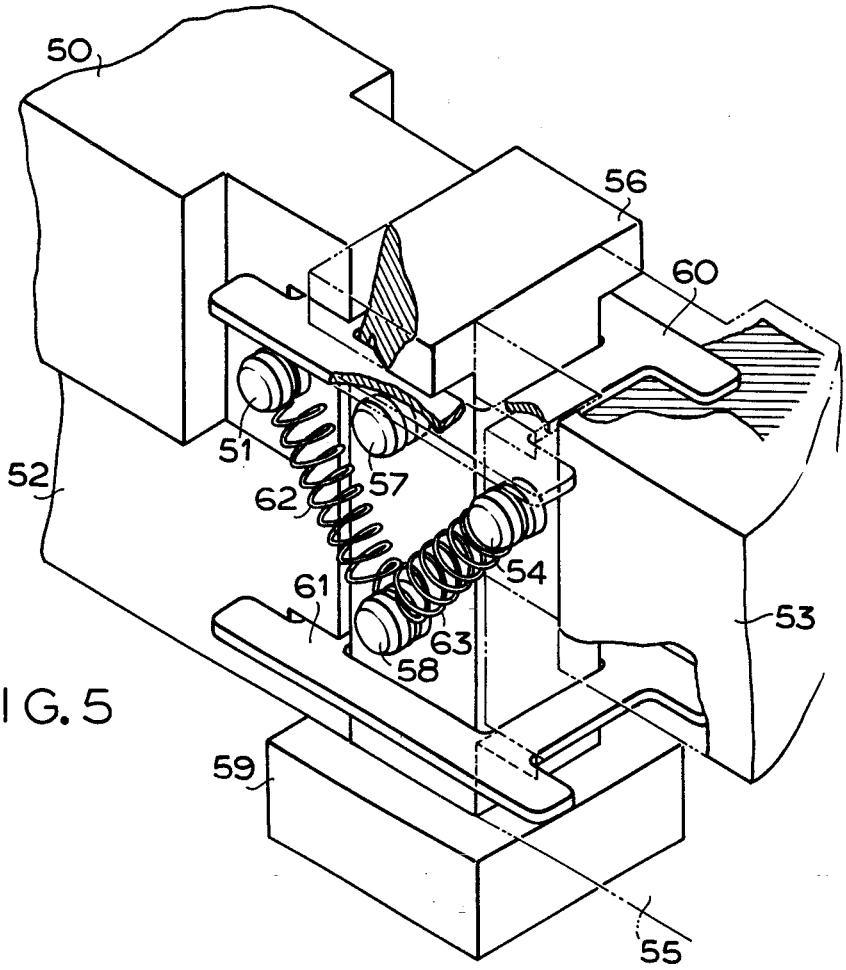
FIG. 5 is a perspective view showing the detail of the construction of the platen.

The operation of a case wherein the thickness of the recording medium is small as in the case of a single sheet of a slip and wherein the locking lever 64 locks the central platen unit 56 will now be described with reference to FIG. 6. In this case, as above described, the platen clamps a thin recording medium 7 between it and the receiving members 5, and, the portion 64*b* of the locking lever 64 is in the dotted line position 64*b*-1 thereby locking the shoulder member 59 as shown by dotted lines 59-1. Under these conditions, when the rotary cam 18 is rotated to raise the follower roller 33 and when the platen push up plate 31 rotates against the force of the cam reset spring 35, the lifting plate 43 and the platen supporting plate 46 tend to move downwardly to follow up the cam portion 31*a* by the force of the platen reset spring 49 acting through the lifting roller 45. However, the central platen unit 56 cannot descend because it is locked by the locking lever 64. Consequently, left and right hand platen units 50 and 53 cannot descend because they are prevented from descending by the shoulder member 56 as shown in FIGS. 3 and 5. Then, when the rotary cam 18 rotates and the follower roller descends, the locking portion 64*b* disengages the shoulder member 59 whereby the central, left and right hand platen units 56, 50 and 53 are reset to the positions shown in FIGS. 3, 4 and 6. When the platen is reset in this manner, the magnet 20 secured to the disc 19 rotating with the rotary cam 18 approaches the reed switch 25 to close its contact thus interconnecting the lead wires 27 and 29. Thus, the fact that the platen has lowered to the lowest position is detected and a signal is sent to the control circuit, not shown. In response to this signal, the control circuit deenergizes the trigger solenoid 14 to release the armature 14*d*. Accordingly, the bent portion 12*a* of the trigger lever 12 arrests the control disc 10*b* of the spring clutch 10 to disengage the spring clutch 10. As a result, the motion transmission shaft 9 and the cam shaft 16 stop immediately. At the same time, the control circuit stops the motor 2. Thereafter, the printed recording medium is line shifted or discharged by a paper feed device, not shown.

Although, above described embodiment shows a platen made up three units, in a printer designed for printing only laterally foldable deposit pass books, a flat sheet of paper or the like, the platen may comprise only one unit and the locking device may be omitted, thus simplifying the construction and reducing the cost.

As above described, the platen supporting structure requires a relatively small number of component parts of less accuracy and a small occupation space because the width of the assembly is small. Moreover as the novel platen supporting structure can be readily continued with other mechanisms of the printer and permits ready mounting and dismounting of the printing head. Further, there is no sliding portion requiring oiling thereby increasing the reliability and durability. Accordingly, it is possible to satisfactorily print on recording media having different thickness portions such as longitudinally or laterally foldable deposit pass books of banks as well as recording media of uniform thickness whether the printing is made by contacting the printing head with the recording media or by holding the printing head close to the recording media.

While the invention has been shown and described in terms of a preferred embodiment thereof it should be understood that many changes and modifications will be obvious to one skilled in the art without departing from the true spirit and scope of the invention as defined in the appended claims.

What is claimed is:

1. A printer for printing on a recording medium including longitudinally folded bankbooks, laterally folded bankbooks and slips comprising:

(a) a movable printing head for printing the surface to be printed of said recording medium;

(b) a movable platen provided on the side of said recording medium opposite said printing head;

(c) a supporting frame for supporting said printing head;

(d) positioning means mounted on said frame of said printer in parallel with a direction of movement of said printing head for maintaining the spacing between said surface to be printed of said recording medium and said printing head at a constant value;

(e) platen supporting means including a plurality of parallel leaf springs secured to said frame for supporting said movable platen always in parallel with said recording medium;

(f) platen driving means for moving said movable platen toward and away from said positioning means by use of said platen supporting means; and (g) platen control means operatively connected to said movable platen driving means for detecting the position of said movable platen and for stopping said platen driving means when the upper surface of said recording medium is pushed by said movable platen toward said positioning means and when said platen reaches a position spaced a predetermined distance from said positioning means.

2. The printer according to claim 1 wherein said platen control means comprises a first detector member which detects the fact that said movable platen is in a position in which said recording medium is in an urging position with reference to said positioning means, a second detector member which detects the fact that said movable plates is in a position spaced from said positioning means, and means for stopping said platen driving means in response to signals produced by said first and second detector members.

3. The printer according to claim 2 wherein said platen driving means comprises an electric motor, a worm, a motion transmission member, a releasable clutch interposed between said motor and said motion transmission member for selectively transmitting rotation from said motor to said member, a worm wheel driving by said motion transmission member through the worm, and motion converting means connected to said platen supporting means for converting the rotary motion of said worm wheel into a reciprocation motion for application to said platen supporting means.

4. The printer according to claim 3 wherein said motion converting means comprises a rotary cam operatively connected to said worm wheel and a cam follower connected with said platen supporting means.

5. The printer according to claim 1 wherein said movable platen comprises a left-hand platen unit, a right-hand platen unit and a central platen unit interposed therebetween, said platen supporting means supports said left-hand and right-hand platen units always in parallel with said positioning means, said platen driving means simultaneously moves said left-hand and right-hand platen units toward and away from said positioning means, and wherein said printer further comprises central platen unit supporting means for supporting said central platen unit in parallel with said left-hand and right-hand platen units, and central platen unit locking means for locking said central platen unit when said movable platen pushes said recording medium with said positioning means.

6. The printer according to claim 5 wherein said central platen unit is supported by a pair of guide members movable with said left-hand and right-hand platen units.

7. The printer according to claim 5 wherein said central platen unit locking means is driven by said platen driving means.

8. The printer according to claim 5 wherein said central platen unit locking means locks said central platen unit only when the thickness of said recording medium is smaller than a predetermined value and when said movable platen urges said recording medium against said positioning means.

9. The printer according to claim 5 wherein said central platen unit is provided with a shoulder member to prevent the upper surface of said central platen unit from protruding over the upper surfaces of said right-hand platen unit and left-hand platen unit, and a first spring is provided between said central platen unit and said right-hand platen unit and a second spring is provided between said central platen unit and said left-hand platen unit, and both said springs making the upper surface of said central platen unit protrude over the upper surfaces of said right-hand and left-hand platen units.

10. The printer according to claim 1 wherein said platen driving means comprises an electric motor, a worm, a motion transmission member, a releasable clutch interposed between said motor and said motion transmission member for selectively transmitting rotation from said motor to said member, a worm wheel driving by said motion transmission member through the worm, and motion converting means connected to said platen supporting means for converting the rotary motion of said worm wheel into a reciprocation motion for application to said platen supporting means.

11. The printer according to claim 1 wherein one end of said parallel leaf springs is fixed to said frame, the other end of said parallel leaf springs is secured to said platen supporting means, each said parallel leaf springs clamped at their central portions by means of clamping plates so that said platen supporting means may always support said movable platen in parallel with said positioning means.

12. The printer according to claim 4 wherein said platen control means comprises a first detector member for detecting the condition in which the upper surface of said recording medium is pushed by means of said movable platen by an angular position of said rotary cam, and a second detector member for detecting the condition in which said platen reaches a position spaced a predetermined distance from said positioning means by the angular position of said rotary cam.

13. A printing apparatus for printing a multi-thickness recording medium including bankbooks folded in the longitudinal or the lateral directions comprising:

(a) a frame;
(b) positioning means mounted on said frame for defining the position of said recording medium;
(c) a movable platen provided on the opposite side of said positioning means with reference to said recording medium;
(d) platen supporting means comprising a pair of parallel leaf springs secured to said frame for supporting said movable platen always in parallel with said positioning means;
(e) platen driving means coupled with said platen supporting means for moving said movable platen toward and away from said positioning means; and
(f) platen control means comprising a first detector member which detects the fact that said movable platen is in a position in which said recording medium is in an urging position with reference to said positioning means, a second detector member which detects the fact that said movable platen is in a position spaced from said positioning means, and stopper means for stopping said platen driving means in response to signals produced by said first and second detector members.

14. The printing apparatus of claim 13 wherein said detector members are reed switches.

15. The printing apparatus according to claim 13 wherein said platen driving means includes motion converting means which comprises a rotary cam operatively connected to a worm wheel and a cam follower connected with said platen supporting means.

16. The printer according to claim 15 wherein said platen control means detects the angular position of said rotary cam.

17. The printer according to claim 15 wherein said platen control means comprises a first detector member for detecting the condition in which the upper surface of said recording medium is pushed by means of said movable platen by an angular position of said rotary cam, and a second detector member for detecting the condition in which said platen reaches a position spaced a predetermined distance from said positioning means by the angular position of said rotary cam.

18. The printer according to claim 15 wherein when said platen control means detects the angular position of said rotary cam, a first detector member detects when said platen is in an urging position and wherein a second detector member detects when said movable platen is in a position spaced from said positioning means.

19. A printer station apparatus for printing a recording medium including bankbooks folded in the longitudinal or the lateral directions and slips comprising:

(a) a frame;
(b) positioning means mounted on said frame for defining the position of said recording medium;
(c) a movable platen provided on the opposite side of said positioning means with reference to said recording medium;
(d) platen supporting means secured to said frame for supporting said movable platen always in parallel with said positioning means;
(e) platen driving means coupled with said platen supporting means for moving said movable platen toward and away from said positioning means, and further comprising an electric motor, a motion transmission member, a releasable clutch interposed between said electric motor and said motion transmission member, a worm wheel driven by said motion transmission member through a worm, and motion converting means connected to said platen supporting means for converting the rotary motion of said worm wheel into a reciprocation motion for application to said platen supporting means; and (f) said motion converting means further comprising a rotary cam operatively connected to said worm wheel and a cam follower connected to said platen supporting means through a platen push up cam and a lifting roller.

20. The apparatus of claim 19 further comprising an electric motor, a motion transmission member transmitting a rotational motion of said electric motor to a releasable clutch, said releasable clutch selectively transmitting said rotational motion of said electric motor to a worm, a worm wheel transmitting said rotational motion of said electric motor to motion converting means, said motion converting means converting said rotational motion of said worm wheel to a reciprocating motion, and said motion converting means being connected to said platen supporting means.

21. A printing apparatus for printing a multi-thickness recording medium including bankbooks folded in the longitudinal or the lateral directions comprising:

(a) a frame;

(b) positioning means mounted on said frame for defining the position of said recording medium;

(c) a movable platen provided on the opposite side of said positioning means with reference to said recording medium, said movable platen comprising a left-hand platen unit, a right-hand platen unit and a central platen unit interposed therebetween, a platen supporting means for supporting said left-hand and right-hand platen units always in parallel with said positioning means, a platen driving means simultaneously moving said left-hand and right-hand platen units toward and away from said positioning means, and wherein said printer further comprises central platen unit supporting means for supporting said central platen unit in parallel with said left-hand and right-hand platen units and central platen unit locking means for locking said central platen unit when said movable platen pushes said recording medium positioning means.

* * * * *